US008456071B2

(12) United States Patent
Kadowaki

(10) Patent No.: US 8,456,071 B2
(45) Date of Patent: Jun. 4, 2013

(54) STRUCTURE OF SPARK PLUG DESIGNED TO ENSURE IMPROVED PRODUCTIVITY

(75) Inventor: Satoru Kadowaki, Mie-ken (JP)

(73) Assignee: Denso Corporation, Kariya (JP)

( * ) Notice: Subject to any disclaimer, the term of this patent is extended or adjusted under 35 U.S.C. 154(b) by 33 days.

(21) Appl. No.: 13/325,443

(22) Filed: Dec. 14, 2011

(65) Prior Publication Data

US 2012/0146483 A1 Jun. 14, 2012

(30) Foreign Application Priority Data

Dec. 14, 2010 (JP) ..... 2010-278365

(51) Int. Cl.
*H01T 13/20* (2006.01)

(52) U.S. Cl.
USPC ..... 313/141; 313/143

(58) Field of Classification Search
USPC ..... 313/118, 141, 143
See application file for complete search history.

(56) References Cited

U.S. PATENT DOCUMENTS 4,967,116 A * 10/1990 Oshima ..... 313/141
2010/0289397 A1 11/2010 Hanashi et al.

FOREIGN PATENT DOCUMENTS

JP 2009-054574 3/2009
JP 2009-054579 3/2009

* cited by examiner

*Primary Examiner* — Vip Patel
(74) *Attorney, Agent, or Firm* — Nixon & Vanderhye PC

(57) ABSTRACT

A spark plug for use in an internal combustion engine. The spark plug is equipped with a metal shell, a ground electrode joined to the metal shell, and a center electrode disposed in the metal shell. The ground electrode has a protrusion formed on a top end thereof. The metal shell and the ground electrode are covered with a plated layer which has a thickness of 2 μm to 18 μm, which minimizes the possibility of peeling of the plated layer from the ground electrode while keeping the plated layer as thin as possible without sacrificing the resistance to corrosion on the ground electrode.

6 Claims, 5 Drawing Sheets

STRUCTURE OF SPARK PLUG DESIGNED TO ENSURE IMPROVED PRODUCTIVITY

CROSS REFERENCE TO RELATED DOCUMENT

The present application claims the benefit of priority of Japanese Patent Application No. 2010-278365 filed on Dec. 14, 2010, the disclosure of which is incorporated herein by reference.

BACKGROUND OF THE INVENTION

1. Technical Field

This disclosure relates generally to an improved structure of a spark plug which is used in an internal combustion engine and a production method thereof.

2. Background Art

Spark plugs are known which produces a sequence of electric sparks to ignite an air/fuel mixture introduced into an internal combustion engine for automotive vehicles or motorcycles. Typical spark plugs are equipped with a metal shell (also called a metal case) to be mounted in the internal combustion engine, a ground electrode joined to the metal shell, and a center electrode working to develop the spark between itself and the ground electrode.

Japanese Patent First Publication No. 2009-54574 teaches plastically forming or pressing the ground electrode to form a protrusion which extends toward the center electrode. The protrusion results in a decrease in area of contact the ground electrode with the flame kernel, as produced by the spark between the ground electrode and the center electrode, thus decreasing a quenching (cooling) effect which takes away the heat of the flame kernel to improve the ignitability of the air-fuel mixture. The protrusion also results in an increase in intensity of magnetic field between the protrusion of the ground electrode and the center electrode, which further enhances the ignitability of the air/fuel mixture.

The surface of the metal shell of the spark plug is sometimes plated for rust or corrosion control. When the ground electrode is also plated and then plastically deformed or pressed to form the protrusion, as in the above publication, it may lead to a concern about the peeling of the plated layer from the ground electrode. The use of such a spark plug may result in a misfire in the engine. In order to avoid this problem, the surface of the ground electrode joined to the metal shell may be masked when the metal shell is plated, after which the ground electrode is pressed to make the protrusion and then plated. This, however, results in an increased complexity of making the spark plug and a decrease in productivity thereof.

SUMMARY

It is therefore an object to provide an improved structure of a spark plug designed to minimize the possibility of a misfire in an internal combustion engine and improve the productivity thereof and a method to produce such a spark plug.

According to one aspect of an embodiment, there is provided a spark plug which may be employed in automotive vehicles. The spark plug comprises: (a) a metal shell to be mounted in an internal combustion engine; (b) a ground electrode joined to the metal shell; (c) a center electrode disposed in the metal shell, the center electrode having an end facing a top end of the ground electrode; (d) a plated layer formed over surfaces of the metal shell and the ground electrode, the plated layer having a thickness of 2 μm to 18 μm; and (e) a protrusion formed plastically on the top end of the ground electrode. The protrusion faces the end of the center electrode through a spark gap.

For example, the pressing the ground electrode to make the protrusion after the ground electrode is plated may result in peeling of the plated layer, which leads to a misfire in the internal combustion engine during use of the spark plug. The plated layer is, however, formed to have a thickness of 2 μm to 18 μm which minimizes the possibility of peeling of the plated layer from the ground electrode while keeping the plated layer as thin as possible without sacrificing the resistance to rust on the ground electrode. The plated layer occupies both the surfaces of the ground electrode and the metal shell, thus eliminating the need for masking the ground electrode when the metal shell is plated, thus resulting in simplicity in production process of the spark plug to improve the productivity thereof.

In the preferred mode of the embodiment, the ground electrode is bent between a base end thereof joined to the metal shell and the top end. There is also concern about the peeling of the plated layer from the ground electrode during the bending process, which may lead to a misfire in the internal combustion engine during use of the spark plug. The thickness of the plated layer on the ground electrode is, as described above, selected to be in a range of 2 μm to 18 μm, thereby minimizing the possibility of peeling of the plated layer from the ground electrode while keeping the plated layer as thin as possible, thus resulting in simplicity in production process of the spark plug to improve the productivity thereof.

The ground electrode may be made of a Ni (nickel) alloy containing a main component of Ni and additives of Si, Y, and Ti. The plated layer may be made from Ni. The use of the Ni alloy permits the ground electrode to have a decreased hardness without sacrificing the durability thereof in use of the spark plug, thus facilitating the ease with which the protrusion is plastically formed on the ground electrode. The plated layer is also made from nickel that is close in material characteristics such as thermal stress or chemistry to the ground electrode, thus enhancing the adhesion between the plated layer and the ground electrode. This also permits the plated layer to have a thickness of 2 μm to 18 μm while minimizing the possibility of peeling of the plated layer from the ground electrode when the ground electrode is subjected to the plastic deformation.

According to another aspect of the embodiment, there is provided a method of producing a spark plug equipped with a metal shell, a ground electrode, and a center electrode. The production method comprises the steps of: (a) preparing a sub-assembly of the metal shell and the ground electrode joined to the metal shell; (b) forming a plated layer over surfaces of the metal shell and the ground electrode, the plated layer having a thickness of 2 μm to 18 μm; and (c) plastically deforming a top end of the ground electrode with the plated layer to form a protrusion which is to face the center electrode when disposed in the metal shell.

The plastic deformation of the top end of the ground electrode to form the protrusion may result in peeling of the plated layer from the ground electrode, which leads to a misfire in the internal combustion engine during use of the spark plug. The plated layer is, however, formed to have a thickness of 2 μm to 18 μm which minimizes the possibility of peeling of the plated layer from the ground electrode while keeping the plated layer as thin as possible without sacrificing the resistance to corrosion on the ground electrode. The plated layer occupies both the surfaces of the ground electrode and the metal shell, thus eliminating the need for masking the ground electrode when the metal shell is plated, thus resulting in simplicity in production process of the spark plug to improve the productivity thereof.

In the preferred mode of the embodiment, the method also comprises the step of bending the ground electrode which is covered with the plated layer and on which the protrusion is formed to make a bend between a base end thereof joined to the metal shell and the top end. There is also concern about the peeling of the plated layer from the ground electrode during the bending process, which may lead to a misfire in the internal combustion engine during use of the spark plug. The thickness of the plated layer on the ground electrode is, as described above, selected to be in a range of 2 μm to 18 μm, thereby minimizing the possibility of peeling of the plated layer from the ground electrode while keeping the plated layer as thin as possible, thus resulting in simplicity in production process of the spark plug to improve the productivity thereof.

The ground electrode may be made of a Ni (nickel) alloy containing a main component of Ni and additives of Si, Y, and Ti. The plated layer may be made from Ni. The use of the Ni alloy permits the ground electrode to have a decreased hardness without sacrificing the durability thereof in use of the spark plug, thus facilitating the ease with which the protrusion is plastically formed on the ground electrode. The plated layer is also made from nickel that is close in material characteristics such as thermal stress or chemistry to the ground electrode, thus enhancing the adhesion between the plated layer and the ground electrode. This also permits the plated layer to have a thickness of 2 μm to 18 μm while minimizing the possibility of peeling of the plated layer from the ground electrode when the ground electrode is subjected to the plastic deformation.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
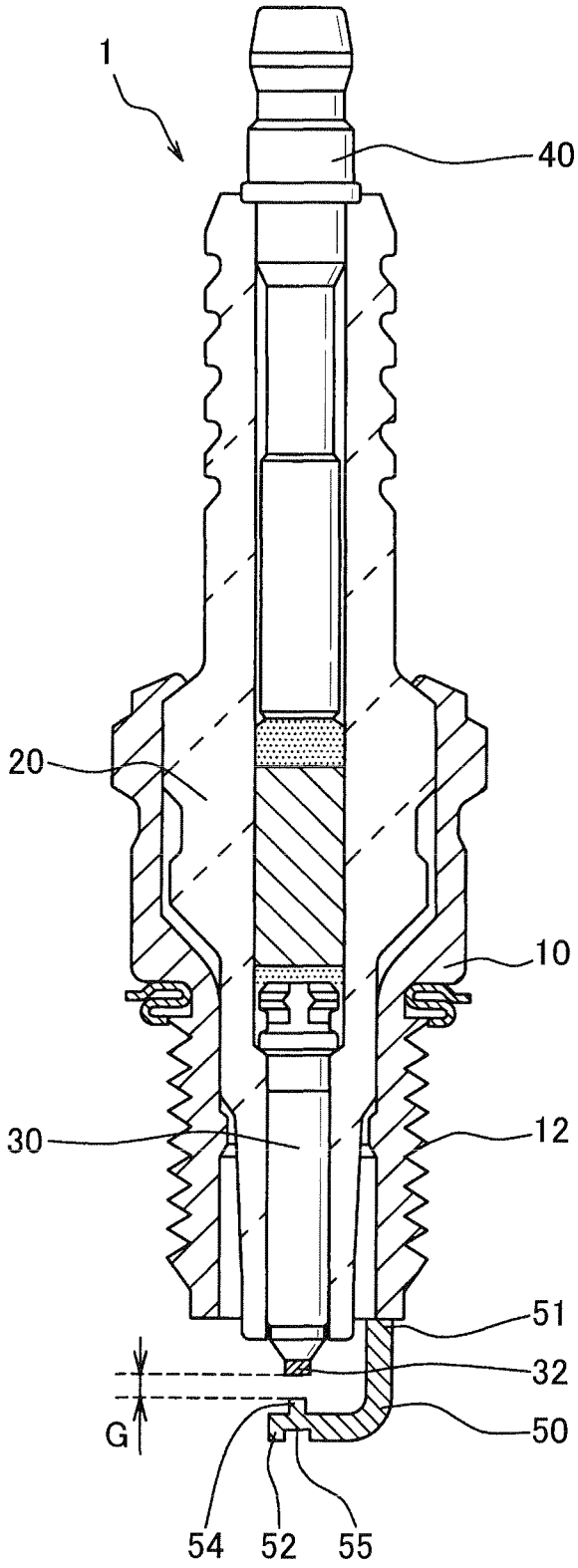
FIG. 1 is a longitudinal sectional view which shows a spark plug according to an embodiment of the invention.

Referring to the drawings, wherein like reference numbers refer to like parts in several views, particularly to FIG. 1, there is shown a spark plug 1 according to the first embodiment which is to be installed in an internal combustion engine mounted in, for example, automotive vehicles, motorcycles, co-generation systems, or gas feed pumps. The spark plug 1 works to produce a sequence of electric sparks to ignite an air/fuel mixture introduced into the internal combustion engine. The spark plug 1 is equipped with a metal shell 10 (also called a metal case), an insulator 20, a center electrode 30, a connector terminal 40, and a ground electrode 50.

The metal shell 10 is of a cylindrical shape and made from metal such as carbon steel. The metal shell 10 has formed on an outer periphery thereof an external thread 12 which is to be installed in a cylinder head of the internal combustion engine using, for example, a screw clamp.

The insulator 20 is of a hollow cylindrical shape and made from a ceramic insulating material such as alumina. The insulator 20 is fit in the metal shell 10 coaxially therewith with ends protruding from opposed ends of the metal shell 10 in a lengthwise direction of the spark plug 1.

The center electrode 30 is of a cylindrical shape and made from metallic material such as an Ni alloy that is the same as the ground electrode 50. The center electrode 30 is fit in the insulator 20 coaxially therewith and has a tip protruding from the tip of the insulator 20. The tip of the center electrode 30 has a noble metal chip 32 affixed thereto. The noble metal chip 32 is made from, for example, Ir (iridium), Rh (rhodium), or Ru (ruthenium). Instead of the noble metal chip 32, the tip of the center electrode 30 may be machined or cut to be thin to have the same feature as that of the noble metal chip 32.

The connector terminal 40 is made of a metal circular cylinder and fit in the insulator 20 coaxially therewith in alignment with the center electrode 30. The connector terminal 40 has an end or tip protruding outside one of the open ends of the insulator 20 which is farther away from the center electrode 30. The connector terminal 40 is used to connect the center electrode 30 electrically to a high-voltage terminal of an ignition coil for the internal combustion engine.

Figure 2:
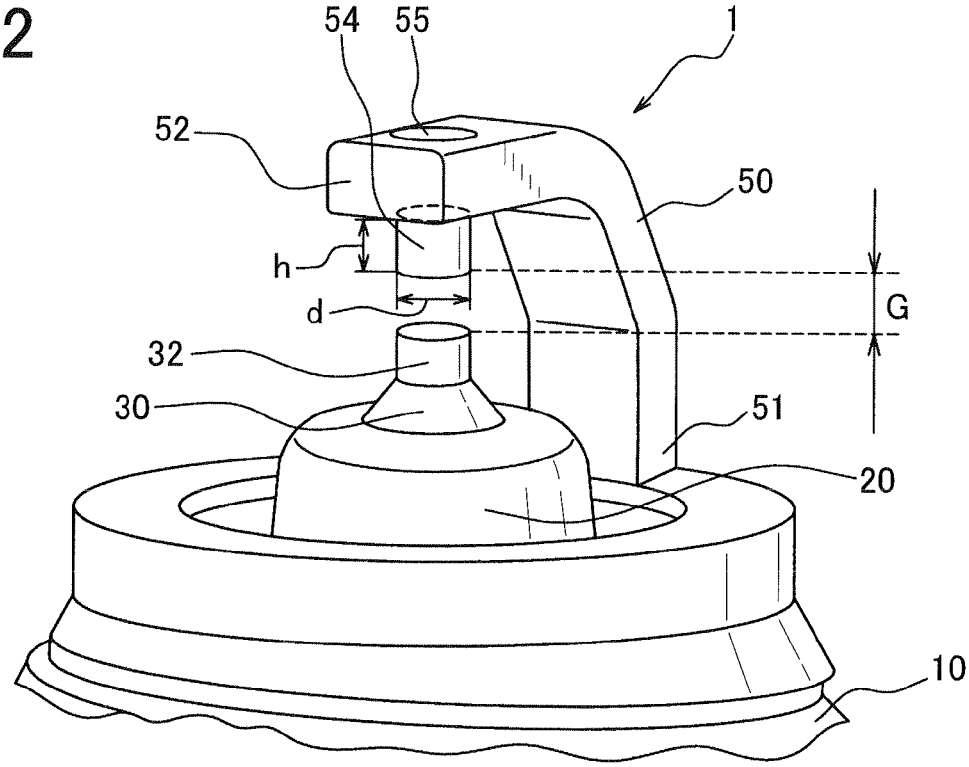
FIG. 2 is a partially enlarged view of a top of the spark plug of FIG. 1.

The ground electrode 50 is made of a metal strip that is rectangular in transverse section. The ground electrode 50 is bent to have an L-shape and has a base 51 and a top 52. The base 51 is mechanically and electrically joined to the end of the metal shell 10. The top 52 faces the chip 32 on the top of the center electrode 30. The top 52 of the ground electrode 50 has a protrusion 54 and a cylindrical recess 55. The protrusion 54 extends toward the center electrode 30 in alignment therewith. The recess 55 is formed on the surface of the ground electrode 50 behind the protrusion 54 and located in alignment or coincident with the protrusion 54 and the chip 32 of the center electrode 30 in the lengthwise direction of the spark plug 1. The protrusion 54, as illustrated in FIG. 2, has an outer diameter d and a length or height h from the surface of the ground electrode 50. The outer diameter d is between 1.0 mm and 1.8 mm. The height h is between 0.5 mm and 1.0 mm. A spark gap G between the facing ends of the protrusion 54 and the chip 32 is between 0.8 mm and 1.0 mm.

The ground electrode 50 is, as described later in detail, bent into the L-shape by the plastic working. The protrusion 54 is formed by pressing the top 52 of the ground electrode 50 together with the recess 55. In order to facilitate the ease of such plastic deformation of the ground electrode 50, a nickel (Ni) alloy which is highly resistant to oxidation by the hot air/fuel mixture and spark-caused wear, but low in hardness and thus easy to machine and which contains Si, Y, and/or Ti is selected as material of the ground electrode 50. For example, the Ni alloy preferably contains 0.5 to 1.5 wt % of Si, 0.01 to 0.2 wt % of Y, and 0 to 0.5 wt % of Ti. The Ni alloy may inevitably contain impurities other than Ni, Si, Y, and Ti.

Figure 3:
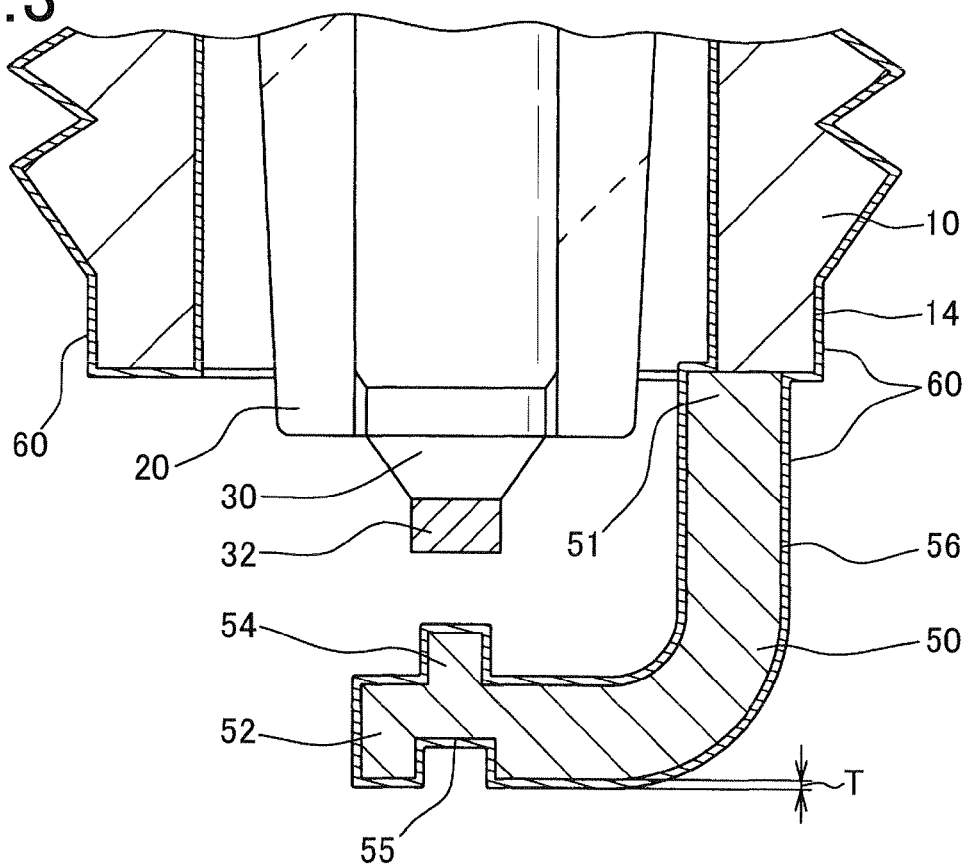
FIG. 3 is a partially sectional view of a top of the spark plug of FIG. 1.

The whole surface 56 of the ground electrode 50 including the protrusion 54 and the recess 55 is, as illustrated in FIG. 3, plated with a metallic layer 60 along with the surface 14 of the metal shell 10. The metallic layer 60 may be made from Ni, Zr, Cu, Pt, Sn, or Cr in terms of giving the ground electrode 50 and the metal shell 10 the rust or corrosion resistance. In the case where the ground electrode 50 is made of the Ni alloy containing a main component of Ni and additives of Si, Y, and Ti, it is advisable that the metallic layer 60 be formed by Ni that is close in material characteristics such as thermal stress or chemistry to the ground electrode 50 in order to enhance the adhesion between the metallic layer 60 and the ground electrode 50. The formation of the metallic layer 60 on the metal shell 10 and the ground electrode 50 may be achieved by one of known plating manners selected depending upon the kind of material of the metallic layer 60. For instance, electrolytic plating (also called electroplating) to deposit metal on the ground electrode 50 that is connected as the cathode to the negative terminal of an external power supply or the non-electrolytic plating (also called electroless plating) to chemically reduce and deposit metal on the ground electrode 50, as immersed in a plating bath.

We performed tests, as described below, to find suitable values of thickness T of the plated layer 60 formed on the surfaces 56 and 14 of the ground electrode 50 and the metal shell 10 in terms of desired characteristics of the plated layer 60.

EXAMPLE 1

Figure 4:
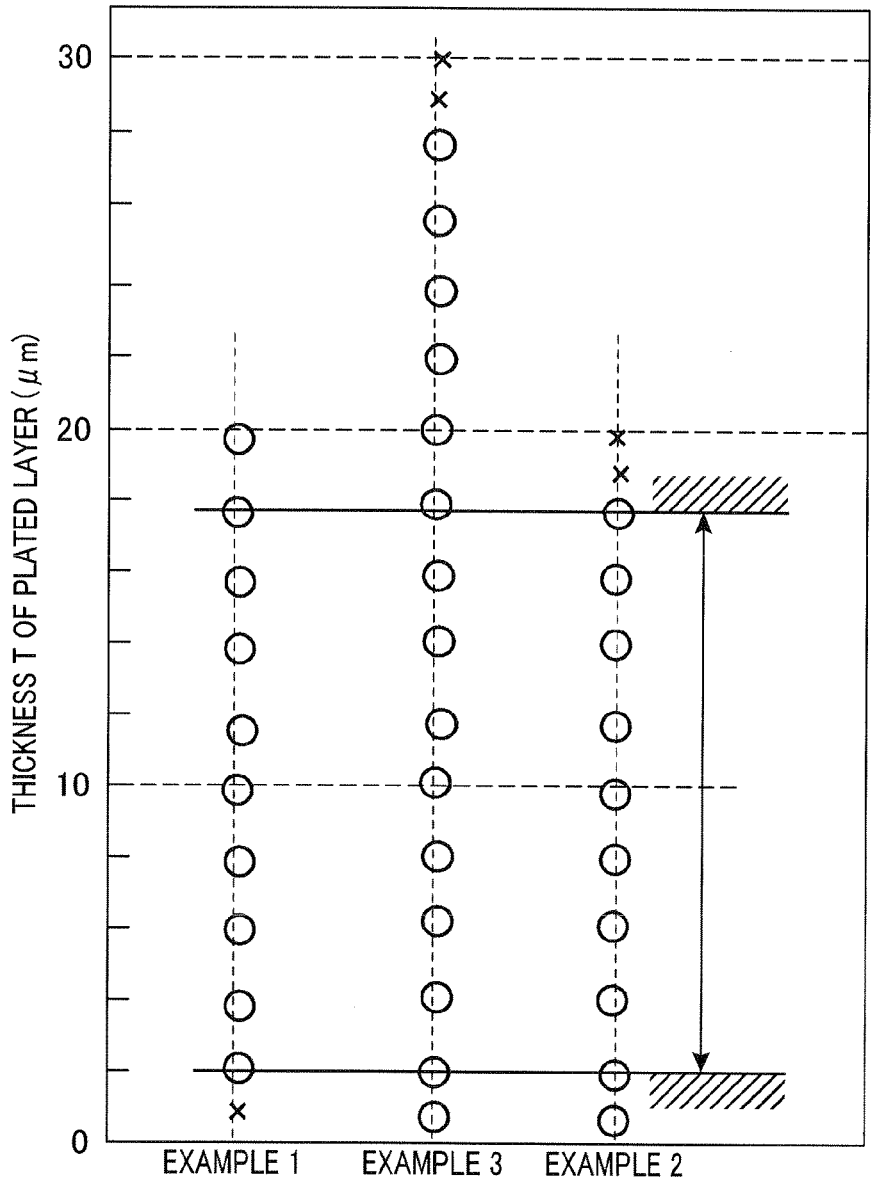
FIG. 4 is a graph which represents results of tests in examples 1, 2, and 3 to evaluate suitable values of thickness of a plated layer formed on a ground electrode and a metal shell of the spark plug of FIG. 1.

We prepared carbon steel-made test samples of the metal shell 10 which are equipped with plated layers 60 of different thickness and performed corrosion resistance tests thereon. Specifically, we had the test samples exposed for 72 hours to hot and humid conditions where the ambient temperature was 40°, and the humidity was 95% and then checked for corrosion on the test samples. FIG. 4 is a graph which illustrates results of the corrosion-resistance tests in the example 1. In the example 1 of the graph, "x" indicates the defective test samples where the corrosion appeared over 10% of the surface 14 of the metal shell 10. "o" indicates the non-defective test samples where the corrosion appeared on less than 10% of the surface 14 of the metal shell 10. The graph shows that when the thickness T of the plated layer 60 is less than 2 μm, the corrosion resistance of the plated layer 60 to provide protection to the metal shell 10 against the corrosion or corrosion will be deteriorated, and thus the thickness T is preferably 2 μm or more.

EXAMPLE 2

Figure 5:
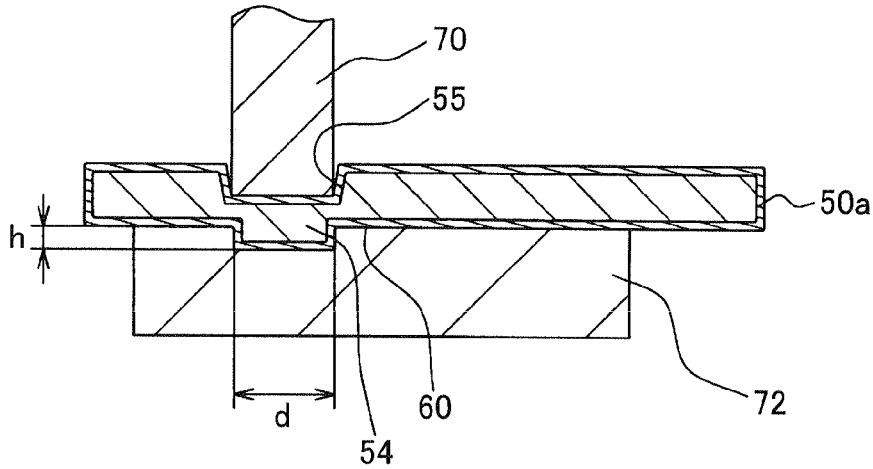
FIG. 5 is a partially sectional view which shows how to press a ground electrode to form a protrusion.

We also prepared, as illustrated in FIG. 5, a plurality of strip test pieces 50*a* of the ground electrode 50 which are rectangular in transverse section and made of an Ni alloy contacting a main component of Ni and additives of Si (silicon), Y (yttrium), and Ti (titanium) and coated them with plated layers 60 of different thickness. We performed press tests on the test pieces 50*a* using a punch 70 and a die 72 to form the protrusion 54 whose diameter d is 1.5 mm and height h is 0.7 mm and then checked for peeling of the plated layers 60 visually. FIG. 4 represents results of the press tests in the example 2. In the example 2 of the graph, "x" indicates the defective test pieces 50*a* where the plated layer 60 is peeled. "o" indicates the non-defective test pieces 50*a* where the plated layer 60 is not peeled. The graph shows that when the thickness T of the plated layer 60 is greater than or equal to 18 μm, it result in peeling of the plated layer 60 from the surface 56 of the ground electrode 50, and thus the thickness T is preferably less than or equal to 18 μm.

EXAMPLE 3

We also prepared, like in the example 2 described above, a plurality of strip test pieces 50*a* of the ground electrode 50 which are rectangular in transverse section and made of an Ni alloy contacting a main component of Ni and additives of Si, Y, and Ti and coated them with plated layers 60 of different thickness. We performed bending tests to bend each of the test pieces 50*a* one time according to the method, as specified by JIS H 8504 1999 in Japanese Industrial Standards and then checked for peeling of the plated layers 60 visually. FIG. 4 represents results of the bending tests in the example 3. In the example 3 of the graph, "x" indicates the defective test pieces 50*a* where the plated layer 60 is peeled. "o" indicates the non-defective test pieces 50*a* where the plated layer 60 is not peeled. The graph shows that when the thickness T of the plated layer 60 is greater than or equal to 28 μm, it result in peeling of the plated layer 60 from the surface 56 of the ground electrode 50, and thus the thickness T is preferably less than or equal to 28 μm.

The examples 1, 2, and 3 show that the thickness T of the plated layer 60 on the metal shell 10 and the ground electrode 50 is preferably between 2 μm to 18 μm, more preferably between 4 μm to 12 μm. Note that in FIGS. 3 and 5, the plated layer 60 is illustrated as being thick as compared with the size of the ground electrode 50 for facilitating better understanding of the structure of the ground electrode 50.

Figure 6:
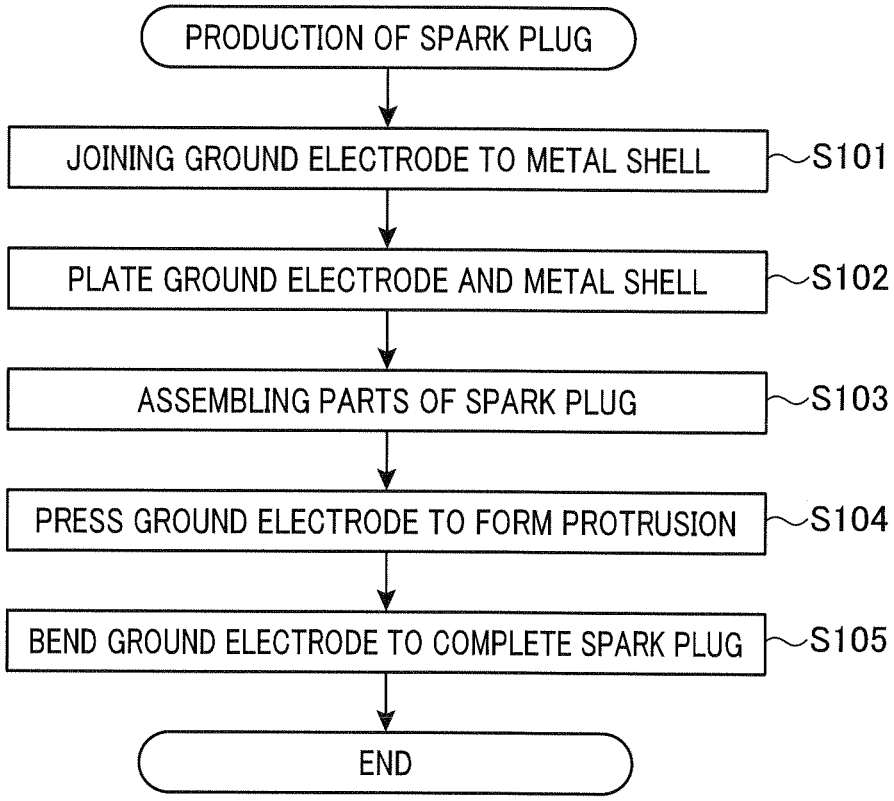
FIG. 6 is a flowchart of a sequence of steps of producing the spark plug of FIG. 1.

FIG. 6 is a flowchart of a sequence of steps to produce the spark plug 1.

First, in step S101, a strip which is made of a Ni alloy containing a main component of Ni and additives Si, Y, and Ti and identical in configuration with the test pieces 50*a* in FIG. 5 is prepared as the ground electrode 50. The ground electrode 50 is then welded to the metal shell 10 made of carbon steel.

The routine proceeds to step S102 wherein a plated layer forming process is performed. Specifically, the sub-assembly of the metal shell 10 and the ground electrode 50 is coated with Ni to form the plated layer 60 whose thickness T lies in a range of 2 μm to 18 μm. The plated layer 60 may be made in the electrolytic plating by immersing the sub-assembly of the ground electrode 50 and the metal shell 10 within an electrolytic bath containing nickel in electrical connection as the cathode to the negative terminal of an external power supply, applying dc current or pulse current to the ground electrode 50, depositing nickel on the surfaces 56 and 14 of the ground electrode 50 and the metal shell 10 until the deposit have the thickness T, as described above. The plated layer 60 may alternatively be made in the non-electrolytic plating by immersing the sub-assembly of the ground electrode 50 and the metal shell 10 within an non-electrolytic bath containing nickel, and subjecting the sub-assembly to the oxidation-reduction or redox reaction to deposit nickel on the surfaces 56 and 14 of the ground electrode 50 and the metal shell 10 until the deposit have the thickness T, as described above.

The routine proceeds to step S103 wherein the insulator 20, the center electrode 30, and the connector terminal 40 are installed in the sub-assembly of the ground electrode 50 and the metal shell 10.

The routine proceeds to step S104 wherein the press process is performed on the assembly of the metal shell 10, the insulator 20, the center electrode 30, the connector terminal 40, and the ground electrode 50 using a punch and a die that are identical with the ones 70 and 72 in FIG. 5. Specifically, the ground electrode 50 is placed on the die 72 and then pressed or driven by the punch 70, so that it is plastically deformed to make the recess 55 and the protrusion 54 simultaneously. The recess 55 and the protrusion 54 are formed to be in coincidence with each other in a direction perpendicular to the thickness of the ground electrode 50. The punch 70 and the die 72 are so designed that the protrusion 54 will have a diameter d of 1.0 mm to 1.8 mm and a height h of 0.5 mm to 1.0 mm.

The routine proceeds to step S105 wherein the bending process is performed on the assembly of the metal shell 10, the insulator 20, the center electrode 30, the connector terminal 40, and the ground electrode 50. Specifically, the ground electrode 50 is bent substantially at right angles using, for example, rollers into the L-shape, as illustrated in FIG. 1, so as to develop the spark gap G between the protrusion 54 of the ground electrode 50 and the chip 32 of the center electrode 30. The spark gap G is in a range of 0.8 mm to 1.0 mm.

There is concern about that the plated layer 60 is peeled from the ground electrode 50 during the press process in step S104 to make the protrusion 54 on the ground electrode 50, which leads to a misfire in the internal combustion engine during use of the spark plug 1. The thickness T of the plated layer 60 on the ground electrode 50 and the metal shell 10 is, however, set in step S102 to 2 μm to 18 μm, thereby minimizing the possibility of peeling of the plated layer 60 from the ground electrode 50 while keeping the plated layer 60 as thin as possible without sacrificing the resistance to corrosion on the ground electrode 50. The plated layer 60 occupies both the surfaces 56 and 14 of the ground electrode 50 and the metal shell 10, thus eliminating the need for masking the ground electrode 50 when the metal shell 10 is plated in step S102, thus resulting in simplicity in production process of the spark plug 1 to improve the productivity thereof.

There is also concern about the peeling of the plated layer 60 from the ground electrode 50 during the bending process in step S105, which leads to a misfire in the internal combustion engine during use of the spark plug 1. The thickness T of the plated layer 60 on the ground electrode 50 and the metal shell 10 is, as described above, selected to be in a range of 2 μm to 18 μm, thereby minimizing the possibility of peeling of the plated layer 60 from the ground electrode 50 while keeping the plated layer 60 as thin as possible, thus resulting in simplicity in production process of the spark plug 1 to improve the productivity thereof.

The ground electrode 50 is made of the Ni alloy contacting a main component of Ni and additives of Si, T, and Ti and thus low in hardness without sacrificing the durability thereof in use of the spark plug 1 in the internal combustion engine. This also facilitates the ease with which the ground electrode 50 is pressed to form the cylindrical protrusion 54. The plated layer 60 is made from Ni that is close in material characteristics such as thermal stress or chemistry to the ground electrode 50, thus enhancing the adhesion between the plated layer 60 and the ground electrode 50. This also permits the plated layer 60 to have a thickness of 2 μm to 18 μm while minimizing the possibility of peeling of the plated layer 60 from the ground electrode 50 in the press and bending processes in steps S104 and S105.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

Figure 7B:
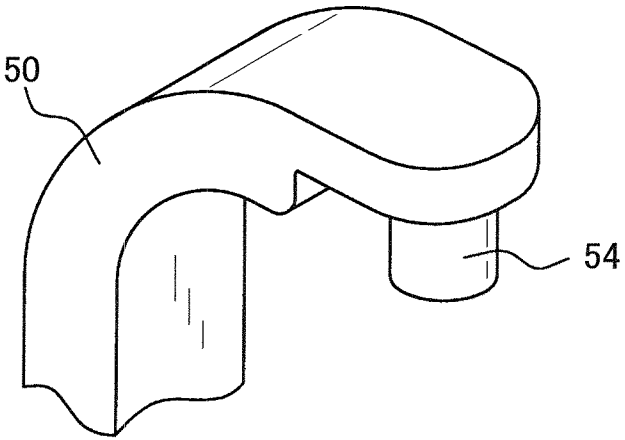
FIGS. 7(*a*) and 7(*b*) are partial perspective views which show modifications of a configuration of a protrusion formed on a ground electrode of the spark plug of FIG. 1.
Figure 7A:
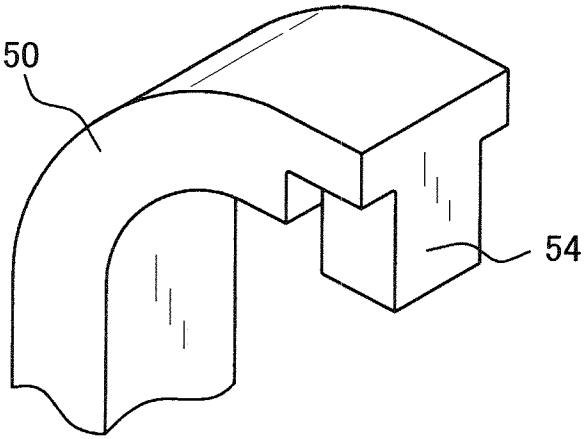

For instance, the protrusion 54 may be formed by locally hammering the thickness of the top 52 of the ground electrode 50 using the forging technique into a square pole, as illustrated in FIG. 7(*a*) or a cylinder, as illustrated in FIG. 7(*b*).

What is claimed is:

1. A spark plug comprising:

a metal shell to be mounted in an internal combustion engine;

a ground electrode joined to the metal shell;

a center electrode disposed in the metal shell, the center electrode having an end facing a top end of the ground electrode;

a plated layer formed over surfaces of the metal shell and the ground electrode, the plated layer having a thickness of 2 μm to 18 μm; and a protrusion formed plastically on the top end of the ground electrode, the protrusion facing the end of the center electrode through a spark gap.

2. A spark plug as set forth in claim 1, wherein the ground electrode is bent between a base end thereof joined to the metal shell and the top end.

3. A spark plug as set forth in claim 1, wherein the ground electrode is made of a Ni alloy containing a main component of Ni and additives of Si, Y, and Ti, and wherein the plated layer is made from Ni.

4. A method of producing a spark plug equipped with a metal shell, a ground electrode, and a center electrode, comprising the steps of:

preparing a sub-assembly of a metal shell and a ground electrode joined to the metal shell;

forming a plated layer over surfaces of the metal shell and the ground electrode, the plated layer having a thickness of 2 μm to 18 μm; and plastically deforming a top end of the ground electrode with the plated layer to form a protrusion which is to face a center electrode when disposed in the metal shell.

5. A method as set forth in claim 4, further comprising bending the ground electrode which is covered with the plated layer and on which the protrusion is formed to make a bend between a base end thereof joined to the metal shell and the top end.

6. A method as set forth in claim 4, wherein the ground electrode is made of a Ni alloy containing a main component of Ni and additives of Si, Y, and Ti, and wherein the plated layer is made from Ni.

* * * * *